United States Patent [19]

Bowser

[11] 4,341,153

[45] * Jul. 27, 1982

[54] SPLICING AND TRUSS ASSEMBLY APPARATUS AND METHODS

[75] Inventor: Donald M. Bowser, Barrie, Canada

[73] Assignee: Truswal Systems Corp., Madison Heights, Mich.

[ * ] Notice: The portion of the term of this patent subsequent to Sep. 8, 1998, has been disclaimed.

[21] Appl. No.: 197,543

[22] Filed: Oct. 16, 1980

[51] Int. Cl.[3] ..... B30B 3/04

[52] U.S. Cl. ..... 100/35; 100/159; 100/173; 100/913; 29/432; 227/152

[58] Field of Search ..... 100/35, 159, 173, 176, 100/210, 913; 29/432, 798; 144/246 R, 246 A, 246 G; 227/150, 152, 39

[56] References Cited

U.S. PATENT DOCUMENTS

| | | | |
|---|---|---|---|
| 3,439,607 | 4/1969 | Sanford | 100/913 X |
| 3,785,277 | 1/1974 | Schmitt | 100/913 X |
| 3,855,917 | 12/1974 | Farrell et al. | 100/913 X |
| 3,903,583 | 9/1975 | Adams | 100/913 X |
| 3,908,259 | 9/1975 | Adams | 100/913 X |
| 4,089,107 | 5/1978 | Sanford | 100/913 X |
| 4,154,164 | 5/1979 | Hammond | 100/913 X |

*Primary Examiner*—Peter Feldman

[57] ABSTRACT

Assembly apparatus for simultaneously rolling opposed toothed metal connector plates onto both sides of horizontal wood 2×4's or like structural members. The apparatus is applied to assemble trusses wherein a prefabricated wood frame of chords with end and intermediate spacers is fed between parallel vertical axis powered rollers with V-webs manually applied to each side ahead of and as the frame is compressively driven through. Similar apparatus is employed to splice the ends of wood chords for use in trusses or otherwise.

31 Claims, 22 Drawing Figures

SPLICING AND TRUSS ASSEMBLY APPARATUS AND METHODS

RELATED APPLICATION

This application is a continuation-in-part of my prior application Ser. No. 06/110,366 filed Jan. 8, 1980, now U.S. Pat. No. 4,287,822.

BACKGROUND OF THE INVENTION

Fabricated trusses of the type assembled on the present machine are disclosed in U.S. Pat. No. 4,078,352 and prior apparatus for assembling such trusses is disclosed in U.S. Pat. No. 4,002,116. The trusses comprise upper and lower wood chords which may be two by four or other rectangular shapes having end and intermediate wood spacers forming a preliminary truss frame. Metal V-webs, formed as sheet metal stampings having end and apex plates with vertical teeth struck therein and reinforcing ribs formed in the intermediate V-legs are pressed in opposed relation on either side of a pair of spaced wooden chords to form an elongated fabricated joist. The wood chords may be assembled in either flat or on edge relationship to each other utilizing the same V-web toothed metal plate connectors and in practice various chord sizes such as two by three, two by four, two by five and two by six have been employed with V-web connector heights such as 8", 9¼", 10¾" and 16".

The prior mechanical apparatus employed for assembling such fabricated truss joists comprised a pair of parallel rails upon which brackets were attached for supporting the chords above and along side each of the rails so that web connectors could first be laid upon the rails with teeth upwardly extending for embedding into the downward faces of the chords and upper webs could be aligned by laying them over the top faces of the chords to form a truss having aligned webs on opposite faces of the chords. A pair of clamping devices were movable along the rails for selectively clamping aligned pairs of connector portions on opposite chords against the wood embedding the teeth therein. Sequential movement of the clamping devices to pairs of connectors and clamping thereof involved intermittent step movement and clamping along the length of the joist limiting the speed of assembly to 2,000 linear feet per day with a three man crew compared with speeds in the order of ten times as great on the apparatus disclosed herein.

Wood "2×4" and other size chords for trusses and other uses are commonly spliced in required lengths with rectangular metal connector plates on either side overlapping abutting ends having teeth struck therein to penetrate the wood and securely join the ends with strength equal to the uncut wood. The closest prior art equipment known to applicant for applying such connector plates involves placing adjacent ends of the wood members on their sides in abutting relation in a press with connector plates positioned under and over the joint for application through static hydraulic pressing. The spliced wood commonly ranges from 2×3 to 2×8 inches in cross section with rectangular connector plates of appropriate length ranging from 10 to 14 inches and width from 2½ to 5 inches using 16, 18 and 20 gauge material with struck teeth extending from ¼" to ½".

SUMMARY OF THE PRESENT INVENTION

An important feature of the present invention includes continuous rolling assembly of opposed V-webs on either side of vertically spaced chords passing between spaced parallel powered compression rollers. A pair of operators on either side of the assembly machine place a pair of V-webs onto a lower guide track and against either side of the vertically spaced upper and lower two by four or like chords just ahead of four vertically and laterally spaced opposed compression assembly rollers which continuously drive the upper and lower chords and compress the toothed connector plates of the metal V-webs into embedded assembled engagement with the chords as they pass through the rollers. Preferably the individual V-webs are placed with two lower leg extremities against a lower guide track with the lead leg in abutting engagement with the trailing leg of the next preceding V-web so that in assembled relation a continuous metal truss is formed interrupted however with intermediate spacing for transverse heat ducts or the like which may be readily provided to meet any architectural design requirements. Wooden truss frames with vertical end and intermediate spacers and preassembled and fed between a pair of vertical axis pinch rollers which drive the frame up to the point where the V-webs are manually applied against the sides just before entry between the compression rollers. Adjustability of both entry pinch rollers and compression assembly rollers is provided for on-edge or flat orientation of the upper and lower chords which may range in size from 2"×3" to 2"×6" as well as for vertical spacing which can range over any spacing height required such as 6" to 16".

In order to provide camber for the finished truss joist, so that the upper chord with dead load thereon will provide a horizontal surface when the lower chord is supported at its end in a building structure, the truss is assembled upside down with entry and departure tracks on either side of the compression assembly rollers oriented in slightly sloping relation so as to impose required arching of the respective chord members as they pass through the assembly rollers which, with allowance for springback will be retained in the finished truss joist.

Continuous feed speed in the potential range of up to 60 feet per minute is limited only by the rapidity with which the metal V-webs can be manually placed against the sides of the wood chords ahead of the compression rollers and practical speeds of at least 35 to 40 feet per minute are readily attained.

In order to splice wood chords for use in truss assemblies and elsewhere in accordance with the present invention, a rolling technique is likewise employed similar to that for applying V-webs in assembling trusses but with certain distinctions. Since splicing takes place at substantially spaced intervals, provision is made for inserting the ends of the 2×4s or like wood members to be spliced between rolling heads without feeding their entire length through the rollers as well as for removing the spliced members following application of the splicing plates without completing longitudinal movement through the rollers. This is accomplished by employing two pairs of longitudinally spaced vertical axis semi-cylindrical rolls adapted to accommodate insertion of the wood ends in approximate abutting relation on edge and in an intermediate position between the rollers while their arcuate portions extend outwardly and, with side plates manually or otherwise positioned on either side overlapping the abutting ends, simultaneously actuating the rollers to engage the adjacent wood members with opposed arcuate segment surfaces and drive them with the prepositioned connector plates through the lead rollers which progressively compress the toothed connector plates into embedded assembled engagement as they pass through the lead rollers. The fore and aft pairs of rollers are provided with synchronized drive with the engaging portion of the rear rollers timed slightly ahead of the lead rollers to drive the trailing end into positive abutting engagement before splicing takes place upon passing through the lead rollers. The radius of the rollers is dimensioned to accommodate full assembling engagement of the longest connector plates to be processed within the continuous arc segments of the rollers. The rear rollers are dimensioned slightly larger than the lead rollers but with equal spacing for pressure engagement in order to further assure positive driven abuttment throughout the rolling application of the connector plates.

DETAILED DESCRIPTION OF THE PREFERRED EMBODIMENT

Figure 1:
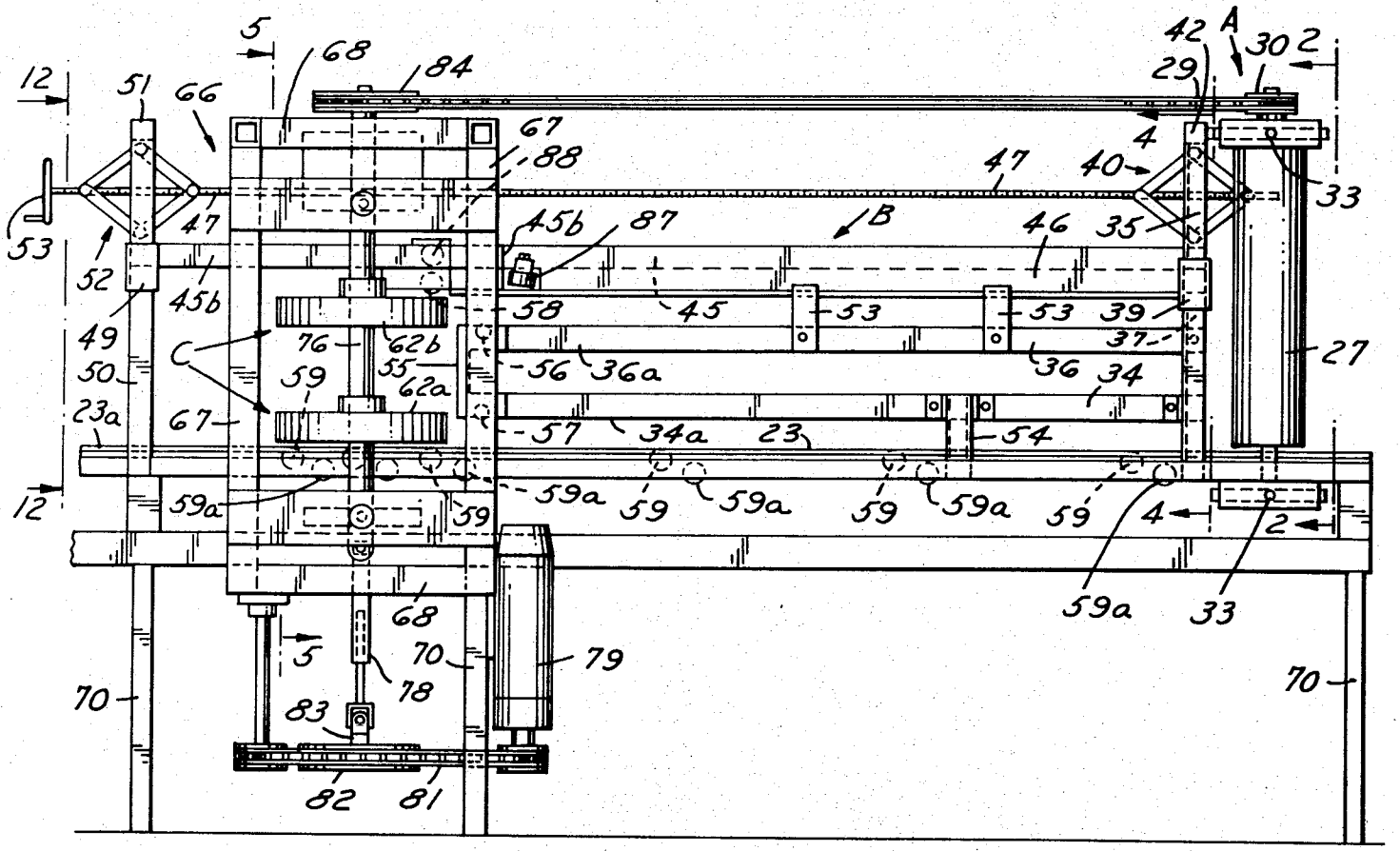
FIG. 1 is a fragmentary side elevation of a preferred embodiment of the truss assembly machine.

With reference to FIG. 1 the major components of the machine include a pair of entrance pinch rollers A, a track system B, two pairs of assembly rollers C and a roller drive D. In general the operation of the machine involves driving a wood truss frame comprising upper and lower two by four type chords preassembled with wood spacers between pinch rollers A along track system B where toothed metal V-webs are manually placed on either side ahead of the assembly rollers C through which the wood frame with applied V-webs are driven and compressively rolled into assembled engagement.

Figure 2:
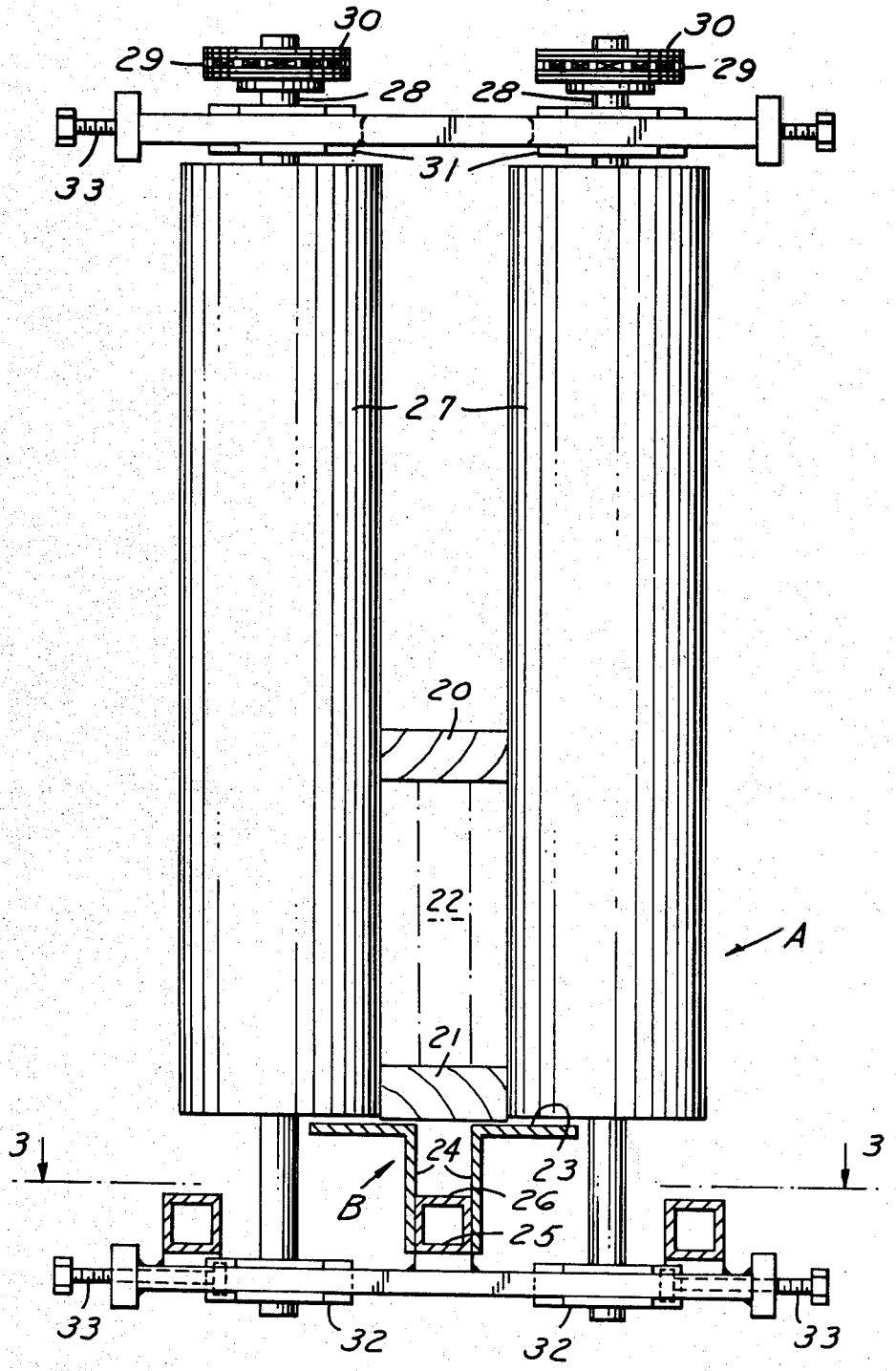
FIG. 2 is an enlarged sectional end elevation taken along the line 2—2 of FIG. 1.
Figure 11:
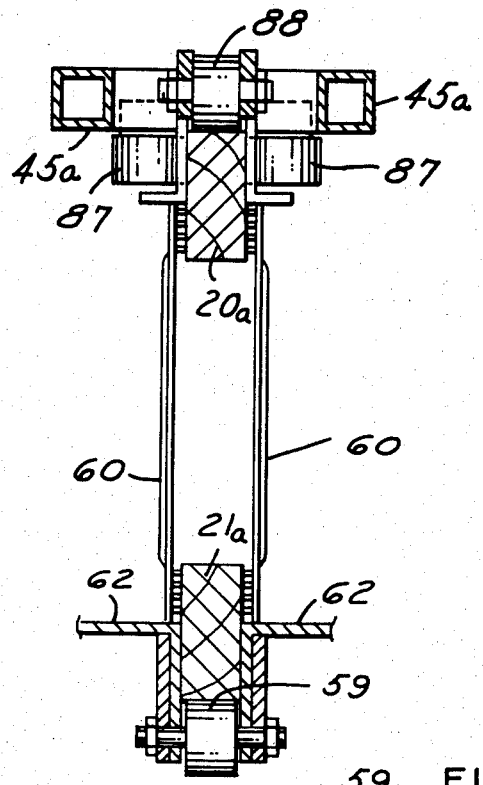
FIGS. 7, 8 9 and 11 are sectional end elevations taken along the lines 7—7, 8—8, 9—9 and 11—11 of FIG. 6.
Figure 15:
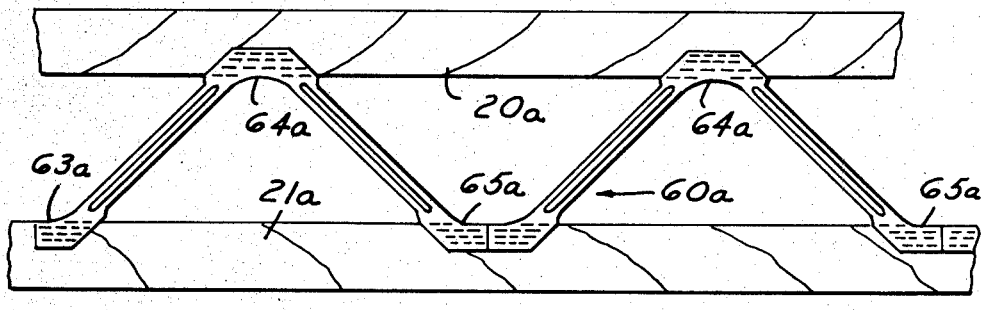

More specifically with reference to FIG. 2, a wood truss frame comprising upper and lower chords 20 and 21 joined by end and intermediate spacers 22 is supported in the case of the illustrated configuration on a series of anti-friction rollers 59 along the horizontal surfaces 23 of a pair of track angles 24 welded to an intermediate square tubular track member 25, the upper surface 26 of which serves as a track with projecting spaced rollers **59*a* for a lower chord oriented on edge as in the optional truss configuration shown in FIG. 15**.

A pair of pinch rollers 27 mounted on vertical shafts 28 driven by chains 29 through sprockets 30 are adjustable through upper slides 31 and lower slides 32 positioned by adjustment screws 33 to a spacing for drivingly engaging the upper and lower chords 20 and 21 for whatever chord widths are being assembled.

Figure 4:
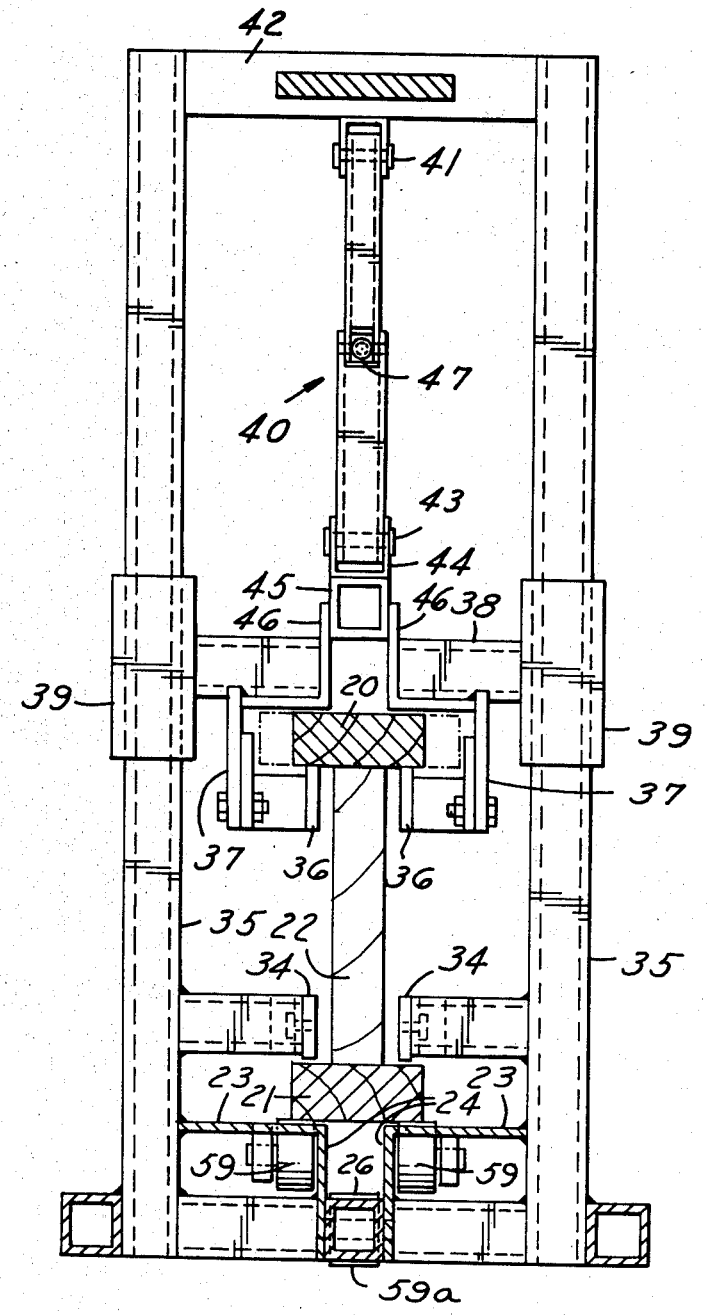
FIGS. 4 and 5 are enlarged sectional end elevations taken along the lines 4—4 and 5—5 of FIG. 1.

As shown in FIG. 4 after passing through the pinch rollers the lead end spacer 22 of the truss frame is guided between lower lateral extensions 34 secured to frame uprights 35 and upper lateral guide members 36, which also serves to support the upper chord from sagging between spacers 22, mounted on hangers 37 from an adjustable cross rail 38 having sleeves 39 slidable on the uprights 35. An adjustment hanger 40 pivotally suspended at 41 from an upper cross frame 42 and pivotally connected at 43 to a bracket 44 and horizontal square tube 45 and angle 46 beam structure serves through horizontally extending screw 47 to adjust the vertical position of the guides 36.

Figure 6:
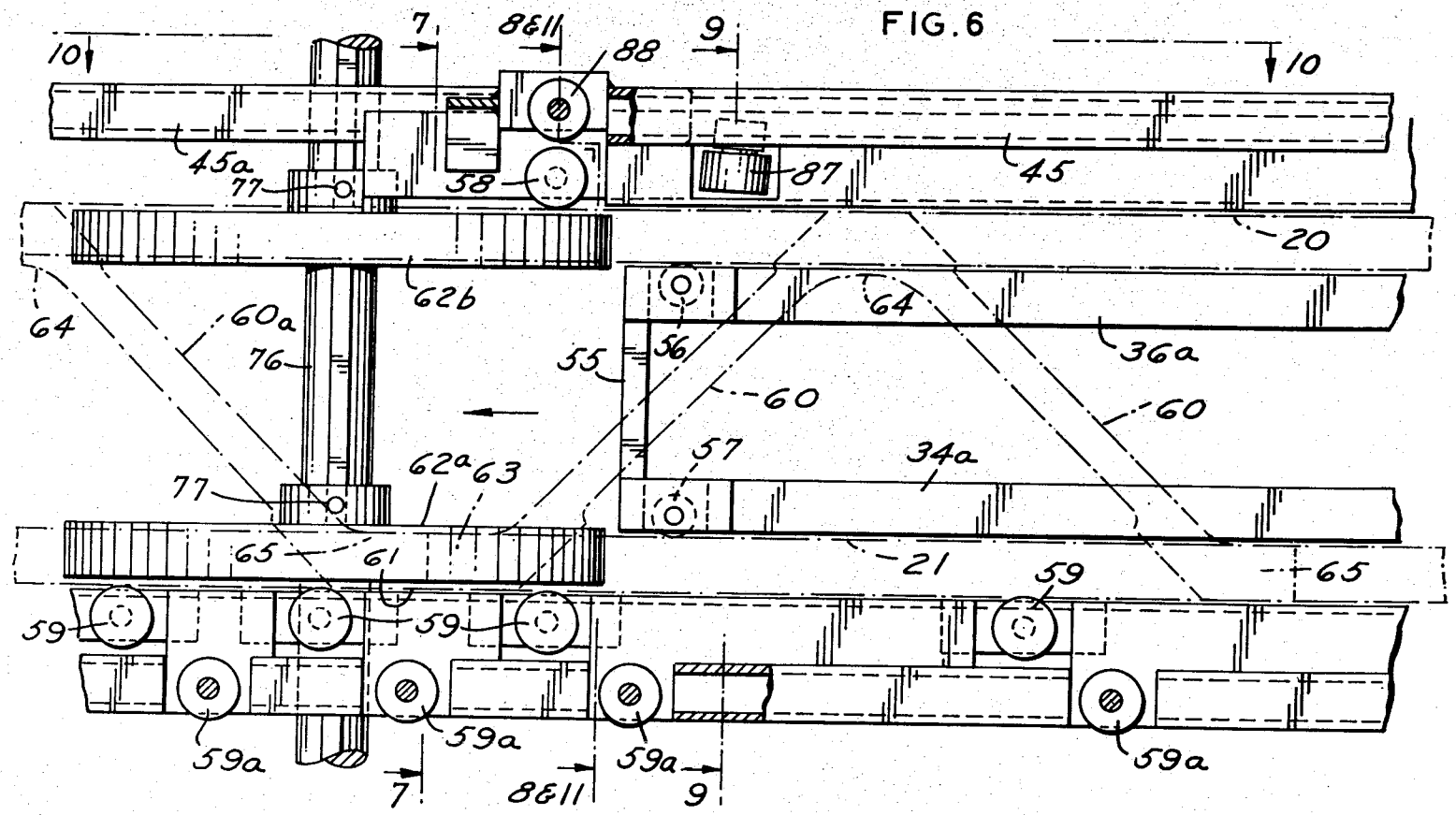
FIG. 6 is a further enlarged fragmentary sectional side elevation taken along the line 6—6 of FIG. 5.
Figure 7:
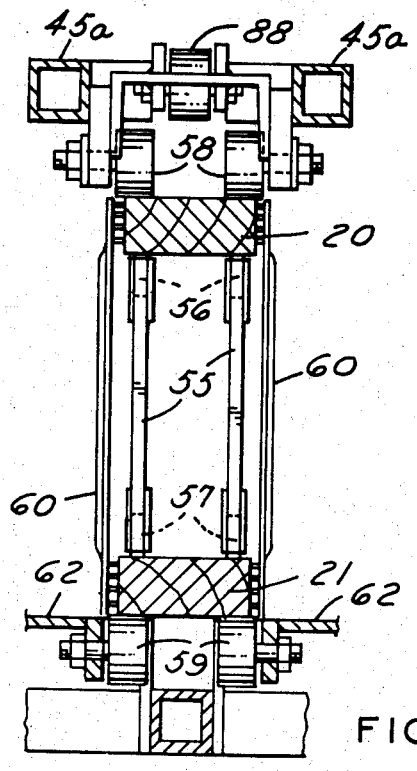
Figure 8:
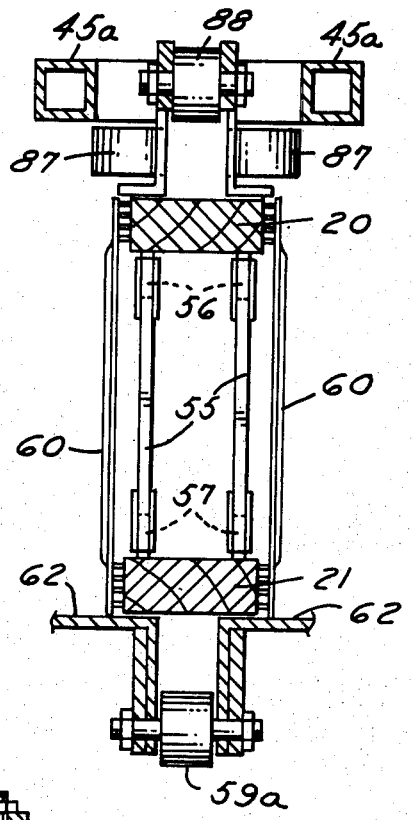
Figure 9:
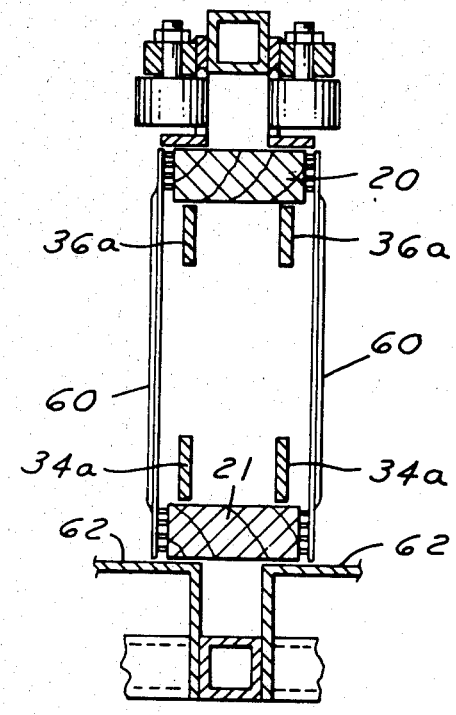

With reference to FIGS. 1, 6, 8, 9 and 12 the horizontal tube 45 branches at section line 8—8 to a pair of spaced tubes **45*a* which extend beyond roller assembly C to connections with transverse member 48 and sleeves 49 piloted on vertical frame members 50 having transverse support 51 for hanger 52 which is similar to hanger 40 and adjustable through horizontal screw 47 actuated by hand crank 53 so that beam assembly 45, 46 may be simultaneously adjusted at both ends along with guide track 36 suspended by bracket 53 secured to angle 46. Lower guide tracks 34 are also supported by brackets 54 and upper and lower extensions 36*a*, 34*a* of guides 36, 34 are connected at their outer ends by spacer bars 55 which position upper and lower inside rollers 56 and 57 mounted near the ends of the extensions 36*a* and 34*a* which with outside upper rollers 58 and lower rollers 59 mounted as shown in FIG. 7 serve to accurately size the spacing of upper and lower chords 20 and 21** immediately before entering between the compression assembly rollers C when assembled as shown with opposing flat sides.

V-web metal truss elements 60 manually placed against either side of the upper and lower chords with the lower leg extremities 61 engaging fixed lower guide tracks 62 are moved into abutting relationship with the trailing legs of the next preceding metal V-web **60*a* and manually held against the chords until compressively engaged by the respective lower assembly rollers 62 which will progressively compress the integral toothed leading connector plates 63, apex connector plates 64 and trailing connecting plates 65** of the opposed metal V-webs into embedded assembled engagement with the respective upper and lower chords.

Figure 3:
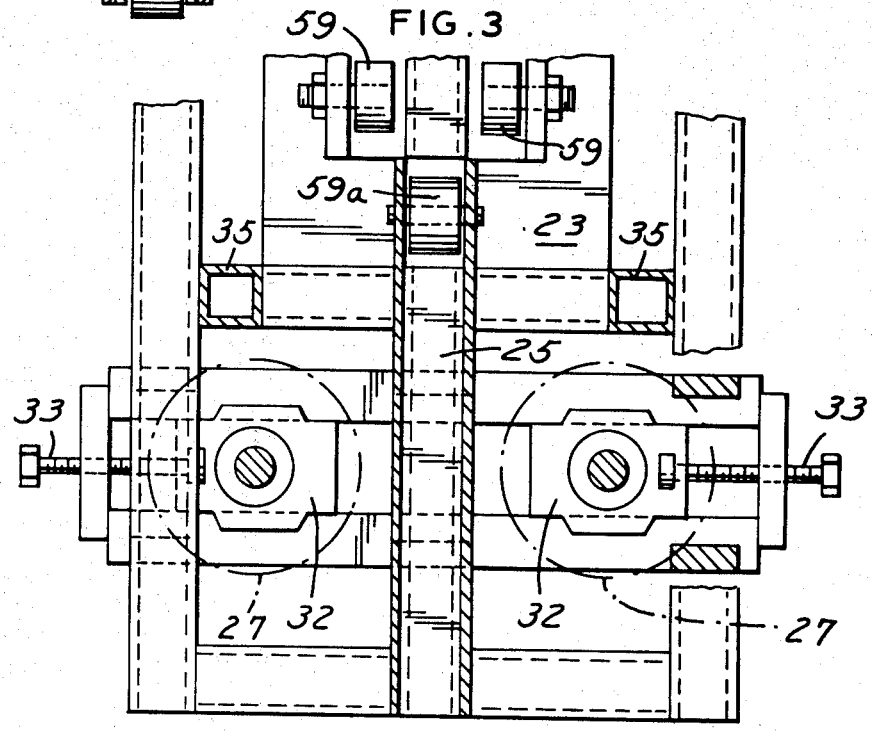
FIG. 3 is a sectional plan view taken along the line 3—3 of FIG. 2.
Figure 5:
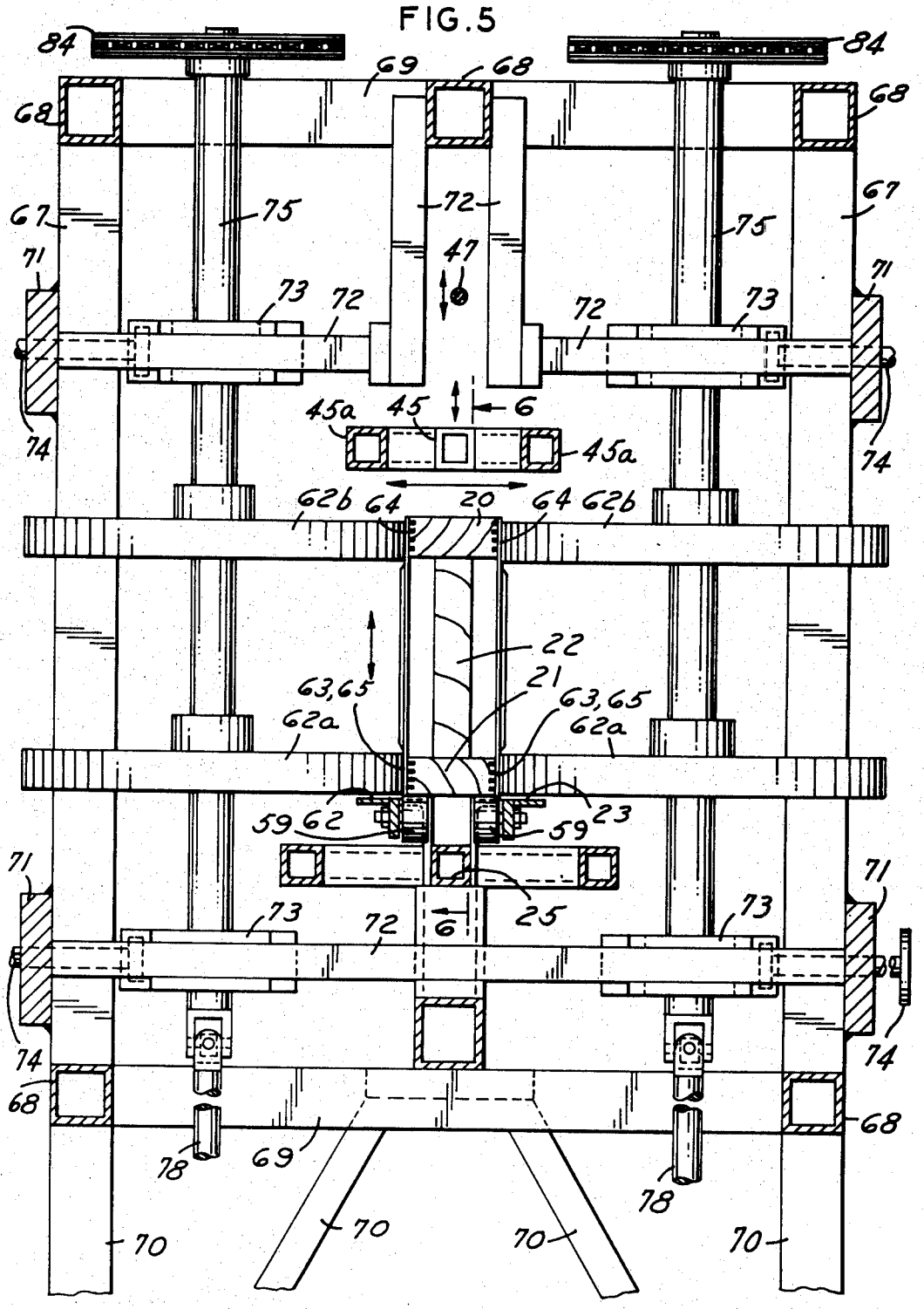

With reference to FIGS. 1 and 5 box frame generally indicated as 66 comprising respectively vertical, longitudinal and transverse frame members 67, 68 and 69 supported on floor legs 70 mounts longitudinal bars 71 and transverse bars 72 on which adjustable journals 73 similar to those illustrated in FIG. 3 are actuated through adjustment screws 74 and vary the position of drive shafts 75 for the lower and upper rollers 62*a* and 62*b* to a proper spacing for engaging the respective chords 21 and 20 and metal V-web connector plates 63, 64 and 65. In practice the rollers are set at a spacing of approximately 1/16" less than the width of the chords to assure compressive drive during engagement between metal connector plates, the additional 0.040" thickness of each of the connector plates being additionally absorbed by compression of the wood and assuring complete penetration of the integral teeth extending at right angles from the connector plates.

Drive keys 76 provided in shafts 75 for slotted engagement by lower rollers 62*a* and upper rollers 62*b*, the latter being readily adjustable in vertical height for different size trusses upon release of set screws 77.

Figure 13:
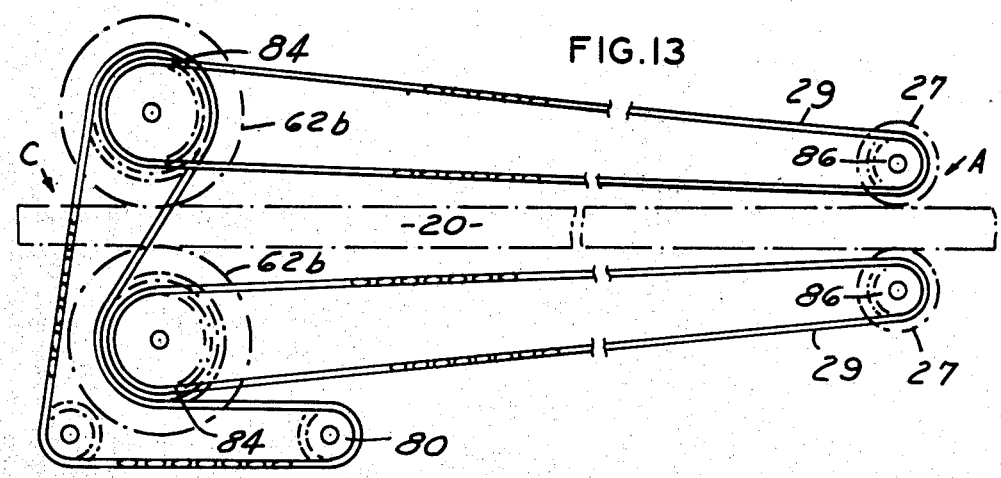
FIG. 13 is a schematic plan view of the chain drive shown in side elevation in FIG. 1.

Oppositely rotating drives are imparted to the drive shaft 75 through universal joint and shaft connections 78 driven by motor 79 through sprocket 80, chain 81, sprockets 82 and couplings 83 as shown in FIG. 1 and the schematic plan view of the drive in FIG. 13. Synchronized drives are imparted to the entrance pinch rollers 27 by power takeoff sprockets 84 at the top of the machine, longitudinal chains 85 and sprockets 86 connected to drive shafts for the pinch rollers 27.

Figure 14:
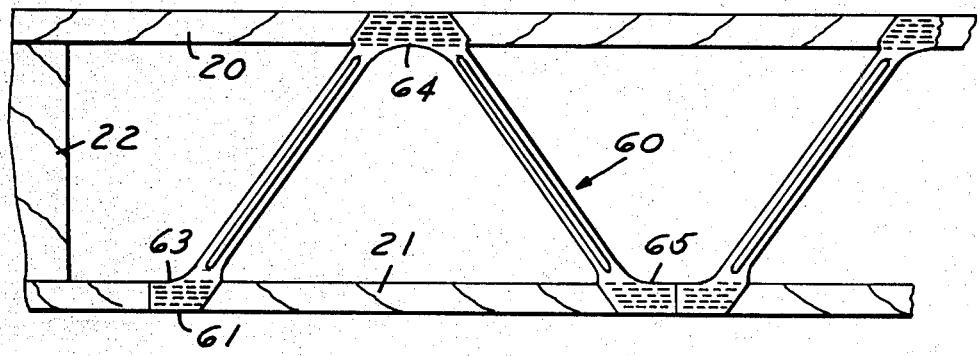
FIGS. 14, 15 and 16 are fragmentary side elevations of assembled truss joists indicating several size and chord configurations which can be assembled on the illustrated machine.
Figure 16:
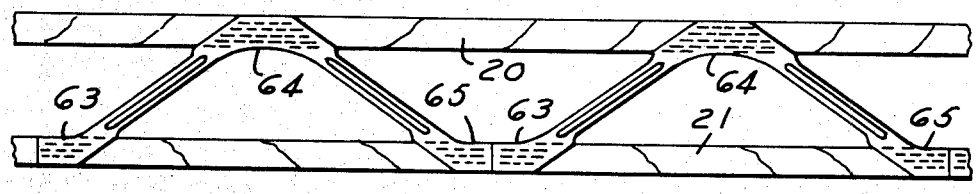

With reference to FIGS. 14, 15 and 16 illustrations of typical different truss sizes and chord orientation are shown which may be accommodated through simple adjustments of the machine which can be effected in approximately 10 to 15 minutes. In the illustrated machine standard chord sizes of 2"×3", 2"×4", 2"×5" and 2"×6" can be accommodated either on edge or flat with connector V vertical sizes ranging between 6 to 16 inches. Currently produced sizes of 8", 9¼", 10¾" and 16" are available and new sizes of 6", 7¼" and 14" are contemplated.

The machine thus far has been described with reference to a typical 10¾" truss with 2"×4" chords in opposed flat relation. Reviewing the sequence of operation, a prenailed frame comprising upper and lower chords 20 and 21 having end and intermediate spacers 22 enter the machine through pinch rollers 27 as shown in FIG. 2 traveling along the rollers in track surface 23 through lateral track guides 34 and 36. As best shown in FIGS. 6 and 7 rollers 56 and 57 accurately spaced by gauge bars 55 establish final inside sizing while upper and lower outer rollers 58 and 59 positively engage the outer chord surfaces and control the chord spacing and positioning as fed between the assembly compression rollers 62*a* and 62*b*. Metal V-webs 60 manually placed on either side with a leading lower leg plate 63 at the lead end of the truss are held until engaged by the lower rollers 62*a* whereupon they are driven continuously through the compression rolls into assembled relation. Successive V-webs are manually placed against the chords and moved forwardly into abutting relationship with the V-legs of the preceding V-webs until such time as an intermediate opening may be programmed, as to accommodate transverse duct passage, whereupon assembly resumes as described.

Desired camber is automatically imparted to the finished truss by providing a slight rising ramp angle on the assembled joist receiving tracks 23*a* which cooperate with the sizing rollers to effect an arching of the chords as assembled in an upside down condition relative to their use as joists supported at their ends.

In order to effect a change in vertical height for a new run of joists it is only necessary to change the level of upper track 45, inserting corresponding different gauge bars 55, and to change the level of the upper compression rollers 62*b* to a corresponding level. In order to effect change for different widths of chords 20 and 21 it is only necessary to adjust the spacing of pinch rollers 27 and the upper and lower compression rollers 62*b* and 62*a*.

Figure 10:
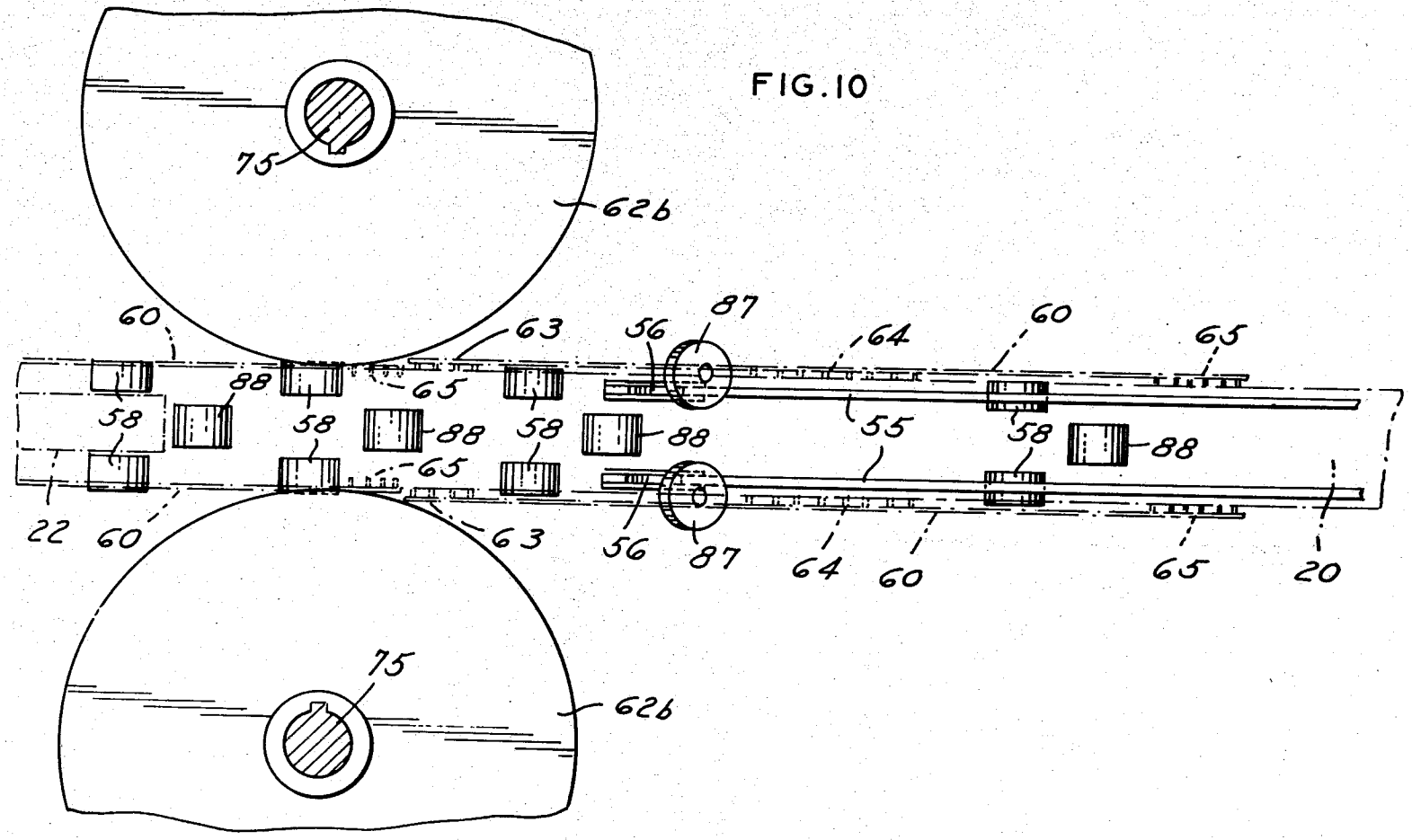
FIG. 10 is a semi-diagrammatic plan view taken along the line 10—10 of FIG. 6 omitting structural parts for clarity.
Figure 12:
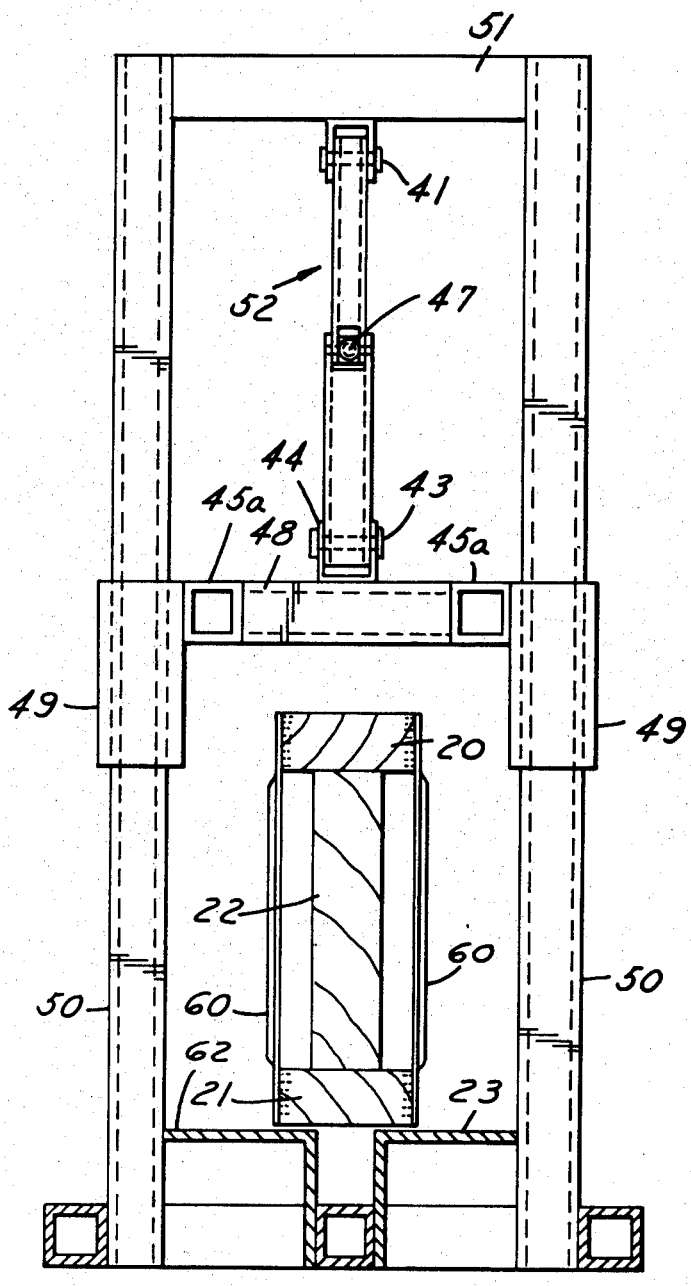
FIG. 12 is an enlarged sectional end elevation taken along the line 12—12 of FIG. 1.

In assembling the trusses with chords on edge the lateral track guides 34 and 36 are not required since the extension of the lower chord 21*a* below the connector plates 63*a* and 65*a* as shown in FIG. 15 is accommodated by the trough formed between the angle surfaces 24 and above the tubular track 26 while the extension of the upper chord 20*a* above the connector plate apexes 64*a* is accommodated by the space between the upper angle track members 46 as will be apparent from an examination of FIG. 4. Accordingly, in fabricating trusses with chords on edge the guide tracks 34 and 36 are removed and stored. In the absence of internal sizing by gauge bar 55 and rollers 56 and 57 as shown in FIG. 6, provision is made through the use of canted rollers 87 adapted to engage the upper chord 20*a* above the level of the connector plate to drive the chord upwardly against the roller 88 in order to effect sizing control of such upper chord (FIG. 10 schematically illustrates in a plan semi-diagrammatic view, with structural parts removed for clear viewing, the arrangement of size control rollers at the upper level.) To adjust for different heights of chord on edge trusses it is only necessary to adjust the level of the upper track through hand wheel 53 and the upper compression rolls 62*b*.

Due to the continuous rolling feature of this machine the speed of assembly is virtually limited only by the rapidity with which V-webs can be placed against the chord elements by operators on either side. Theoretical speeds in the range of 33 to 60 feet per minute are possible while speeds of 35 to 40 feet per minute with the four man crew are readily obtainable, even with the shorter pitch V-webs. Thus, an order of magnitude improvement in speed of assembly has been accomplished compared with prior art apparatus in current commercial use. Furthermore, reduction in set up time in changing from one size to another has been reduced from 45 minutes to approximately 10 minutes.

While the foregoing disclosure of the preferred embodiment involves metal V-webs, it will be understood that the same equipment can be adapted to various forms of connecting web elements such as W-webs, or simple diagonal metal braces having struck out tooth ends for connecting upper and lower horizontal wood chords to adjacent vertical wood spacers, in which case the wood spacers are pre-assembled and the diagonal braces are manually placed in connecting relation ahead of the assembly compression rollers as in the case of the V-webs. Similarly, individual diagonal tooth ended brace elements may be inserted at selective locations next to one of the legs of a V-web to give double strength reinforcement where required, the adjacent V-webs being spaced to accommodate accordingly.

As previously mentioned, the assembly machine can be run continuously at a speed appropriate to manual placement of the V-webs and provision is made for stopping and reversing the drive motor to remedy any misplacement of one of the webs or to effect any other correction which may be required at an intermediate location in the truss.

Figure 17:
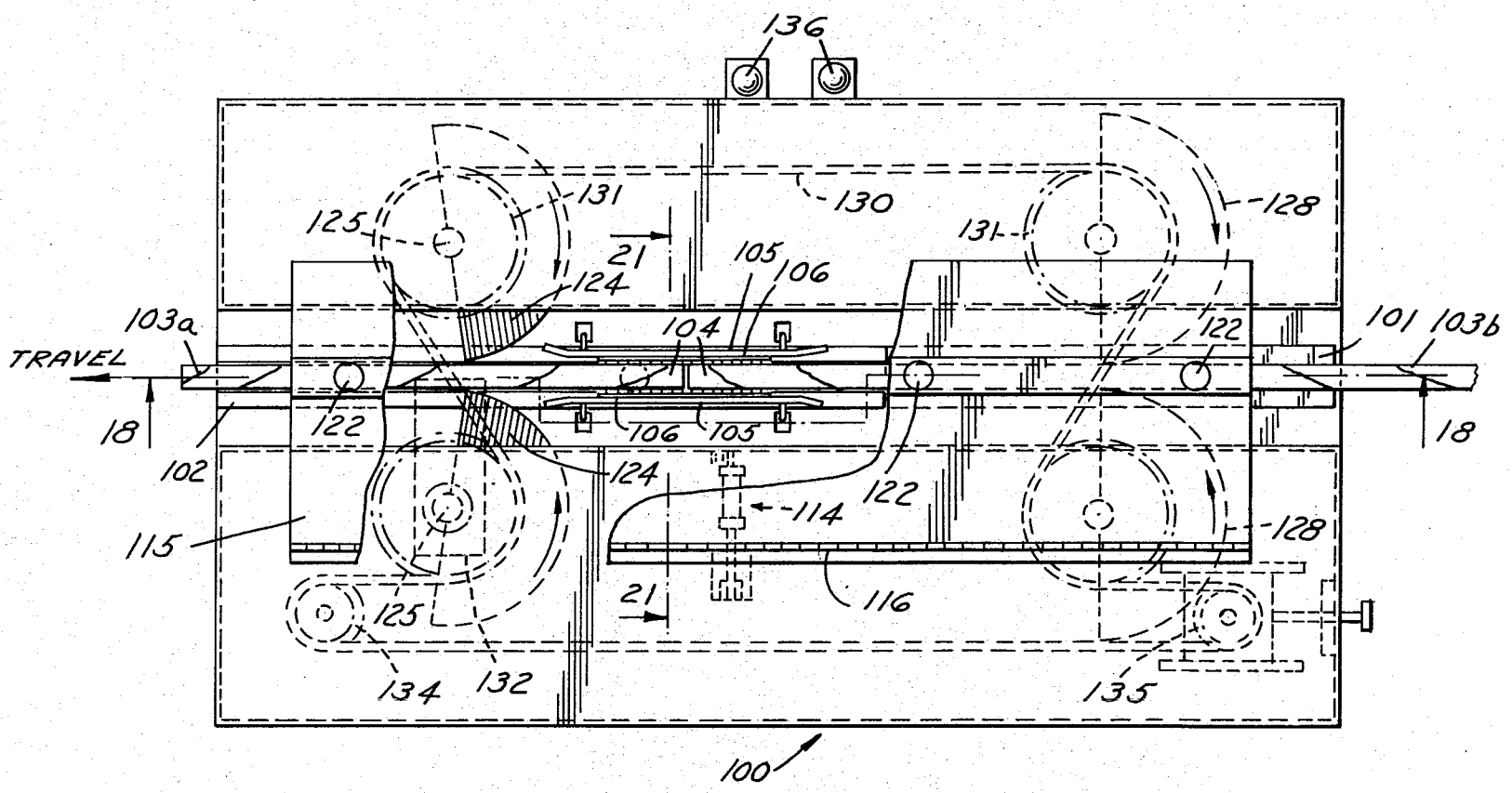
FIG. 17 is a plan view of the splicing apparatus employed in the present invention.

With reference to FIG. 17, splicing apparatus in accordance with the present invention, generally referred to as 100, includes a pair of guide rails 101 on track plate 102 supporting a pair of 2×4s 103*a* and 103*b* with ends 104, in approximate abutting relation between a pair of retractable guide bars 105 for holding a pair of side connector plates 106 in preassembled position overlapping ends 104 to be spliced.

Figure 21:
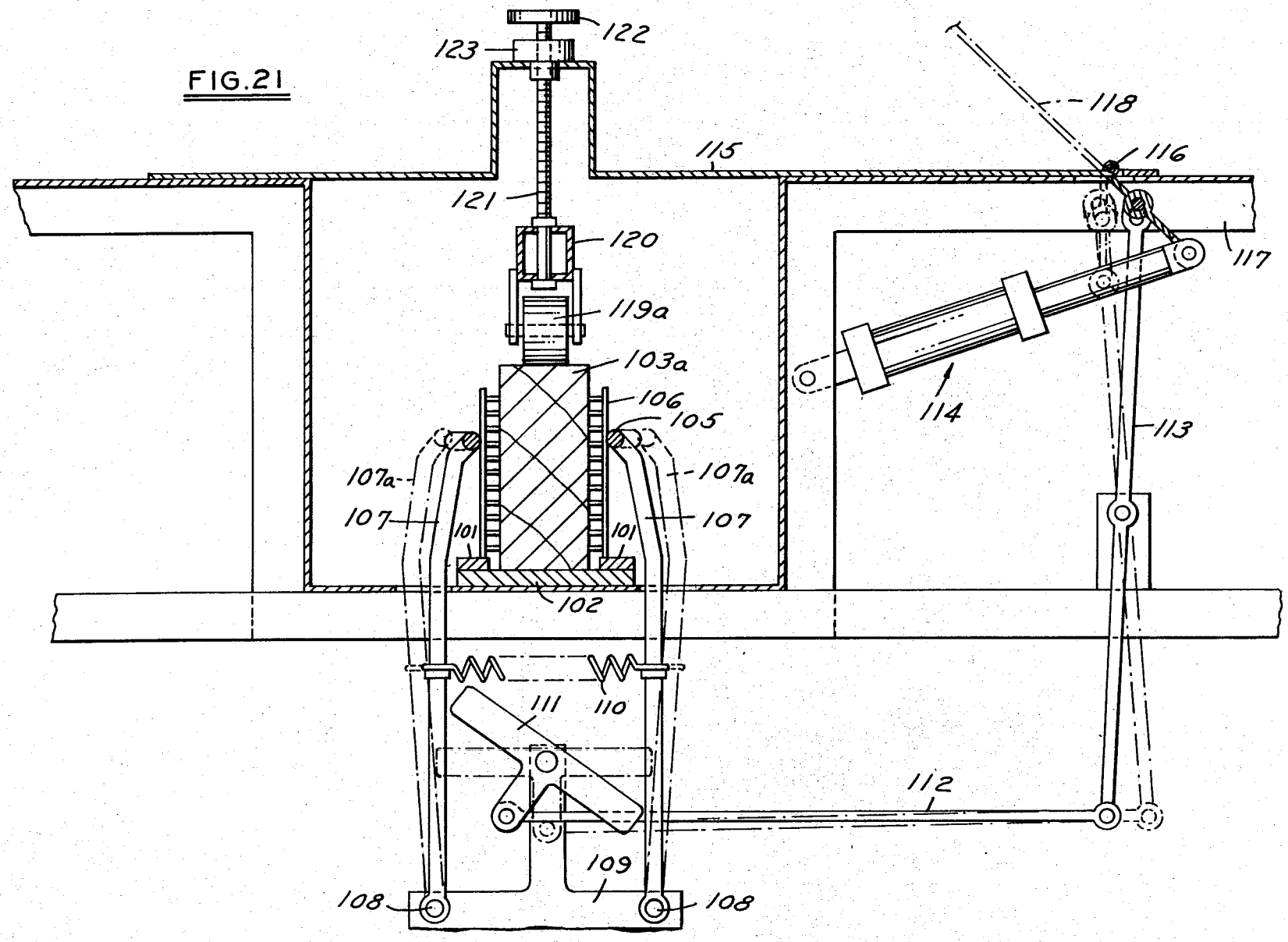
FIG. 21 is a fragmentary end elevation taken along the line 21—21 of FIG. 17.

As shown in FIG. 21 guide bars 105 are mounted on arms 107 pivotally connected at 108 to base number 109 under relatively light tension of spring 110. Arms 107 may be opened to the dotted line position 107*a* for loading and unloading purposes by actuation of bellcrank 111 through linkage 112 and 113 responsive to actuation of power cylinder 114 employed for raising cover 115 pivotably mounted at 116 to fixed framework 117 and opened as shown at 118 to provide loading and unloading access. In closed position of cover 115, a pair of adjustable hold-down rollers 119*a* on either side of roller segments 124 and 119*b* on either side of roller segments 128 engage the top edge surface of respective 2×4s 103*a* and 103*b* to retain them against track 102 during the splicing operation. Rollers 119*a* and 119*b* are mounted on a longitudinal square tube 120 vertically positioned by adjustment screws 121 having hand knobs 122 extending over elongated threaded nuts 123 fixed to the top cover 115.

Figure 19:
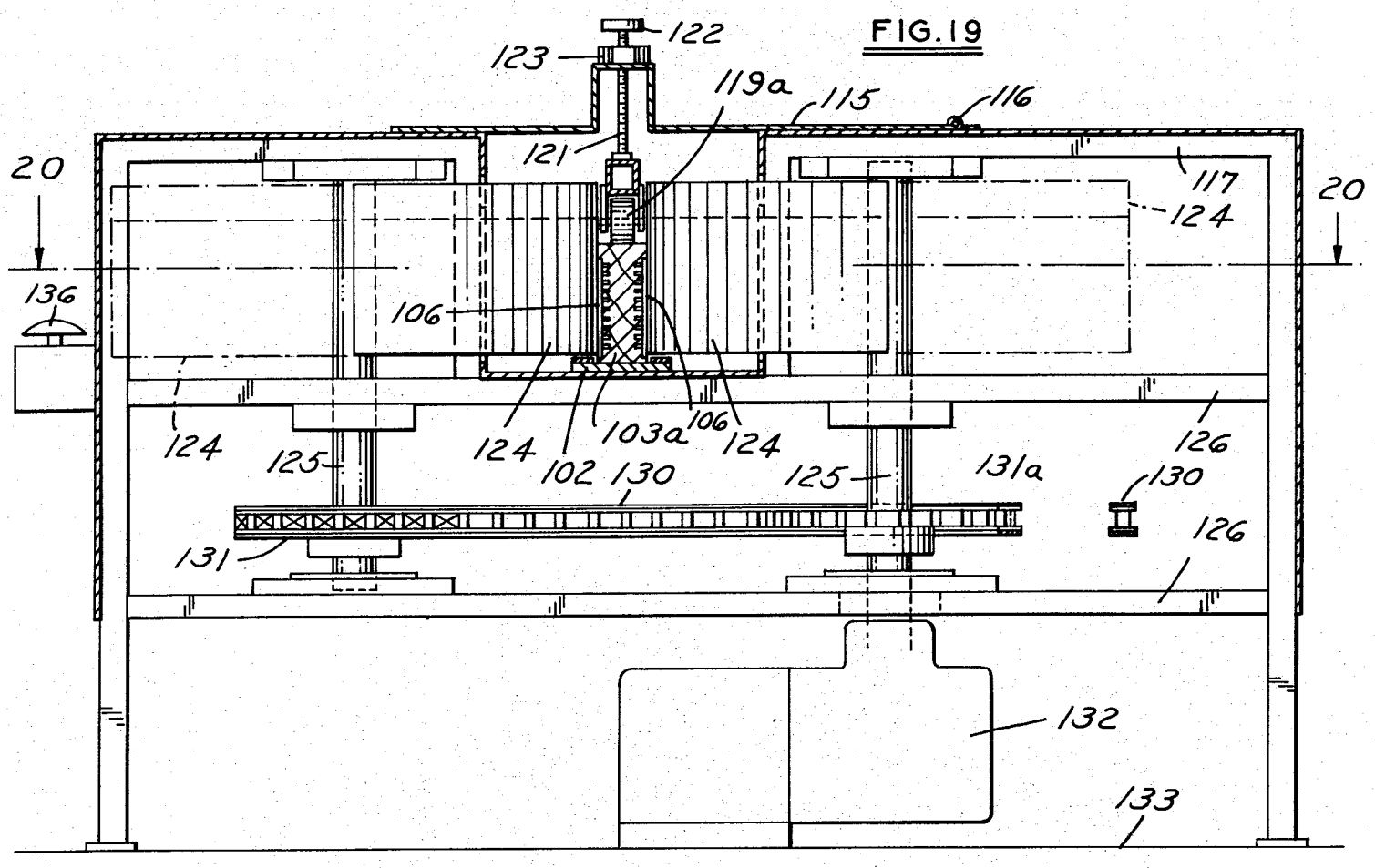
FIG. 19 is a sectional end view taken along the line 19—19 of FIG. 18.

A pair of 14" diameter semi-cylindrical pressing roller segments 124 mounted on vertical drive shafts 125 on framework members 126 in a leading position and a pair of 14¼" diameter semi-cylindrical drive roller segments 128 mounted on vertical drive shafts 129 are respectively driven in synchronized relation by a common drive chain 130, equal drive shaft sprockets 131 and drive motor 132 mounted on apparatus base 133 connected to one of the sprockets 131*a* as shown in FIG. 19.

With reference to FIG. 17, idler sprocket 134 and adjustable take-up sprocket 135 complete the system for synchronized drive of respective roller segments 124 and 128 shown in FIG. 17 at the beginning of drive engagement with 2×4s 103*a* and 103*b* placed with ends 104 in adjacent abutting relation and connector plates 106 positioned between guide bars 105. At the beginning of a cycle, initial drive engagement first takes place by roller segments 128 with 2×4 103*b* moving it into positive abutting engagement with 2×4 103*a* due to the slightly advanced timing of roller segments 128 relative to segments 124. Tension spring 110 shown in FIG. 21 is sufficiently light that engagement of guide bars 105 will not substantially press the struck teeth of connector plates 106 into the 2×4 surfaces to prevent movement of 2×4 103*b* relative to 103*a* to close any clearance gap before roller segments 124 engage and begin to feed the 2×4 103*a*. Furthermore, the differential diameters of roller segments 128 and 124 with uniform sprockets 131 and common drive chain 130 provide a slightly greater peripheral speed for segments 128 to create a differential speed of driving force on the respective 2×4s thereby additionally forcing their ends together during travel toward the compressing roller segments 124.

Figure 20:
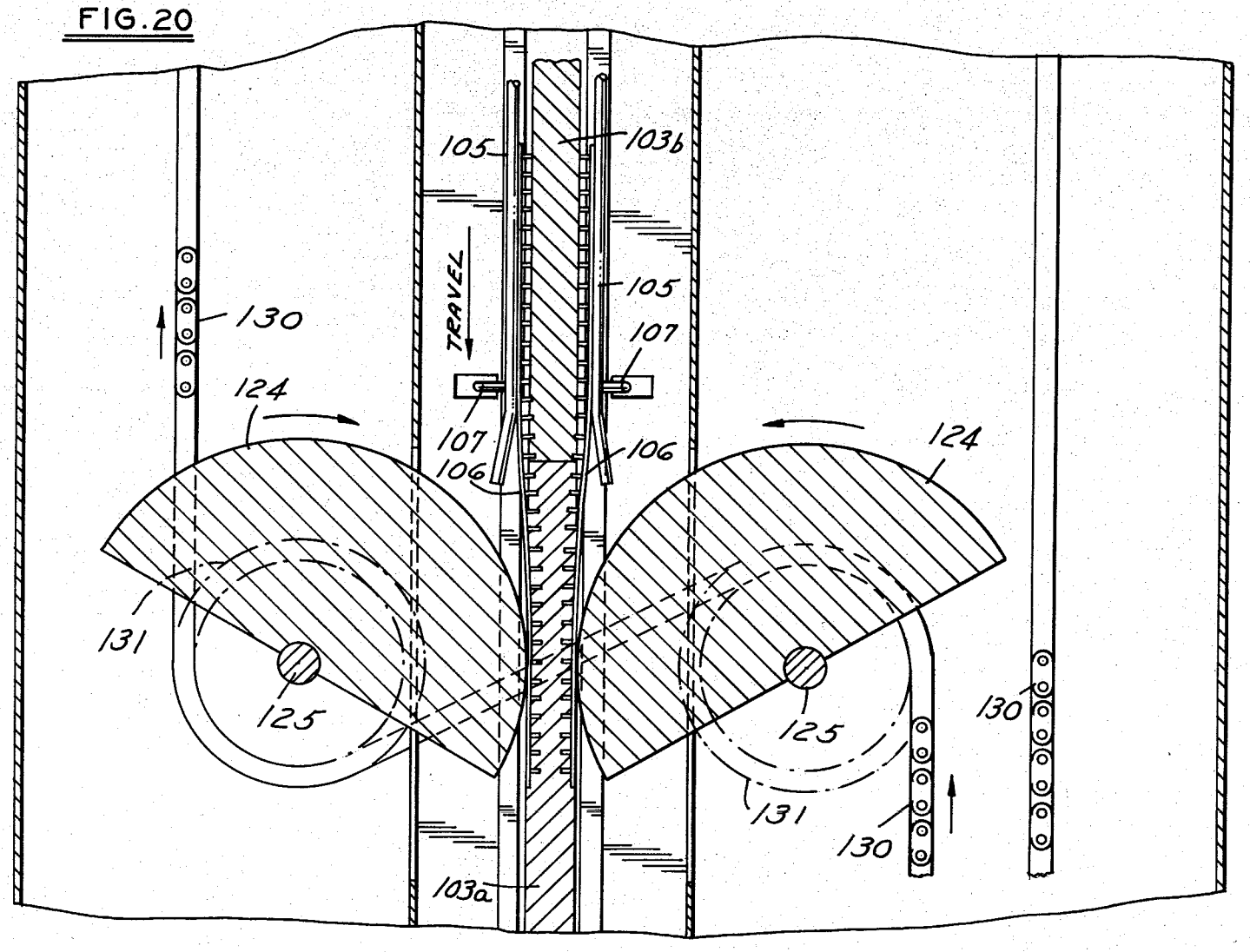
FIG. 20 is an enlarged fragmentary view taken along the line 20—20 of FIG. 19.

The lateral spacing of compressing rollers segments 124 and auxiliary drive segments 128 is such as to equally drivingly engage the sides of the 2×4 with a compressive traction drive. In the case of compressing segments 124 this assures complete penetration of struck teeth of connector plates 106, as best illustrated in FIG. 20, the thickness of such plates being accommodated by compression of the wood fibers during passage between the compressing segments. The 22" semi-peripheral circumference of the compression roller segments is adequate to engage the 2×4 103*a* as illustrated in FIG. 17 and to maintain continuous rolling contact with the longest 14" connector plates throughout their travel between segments whereafter the chain drive is stopped to accommodate removal of the spliced 2×4s.

Figure 18:
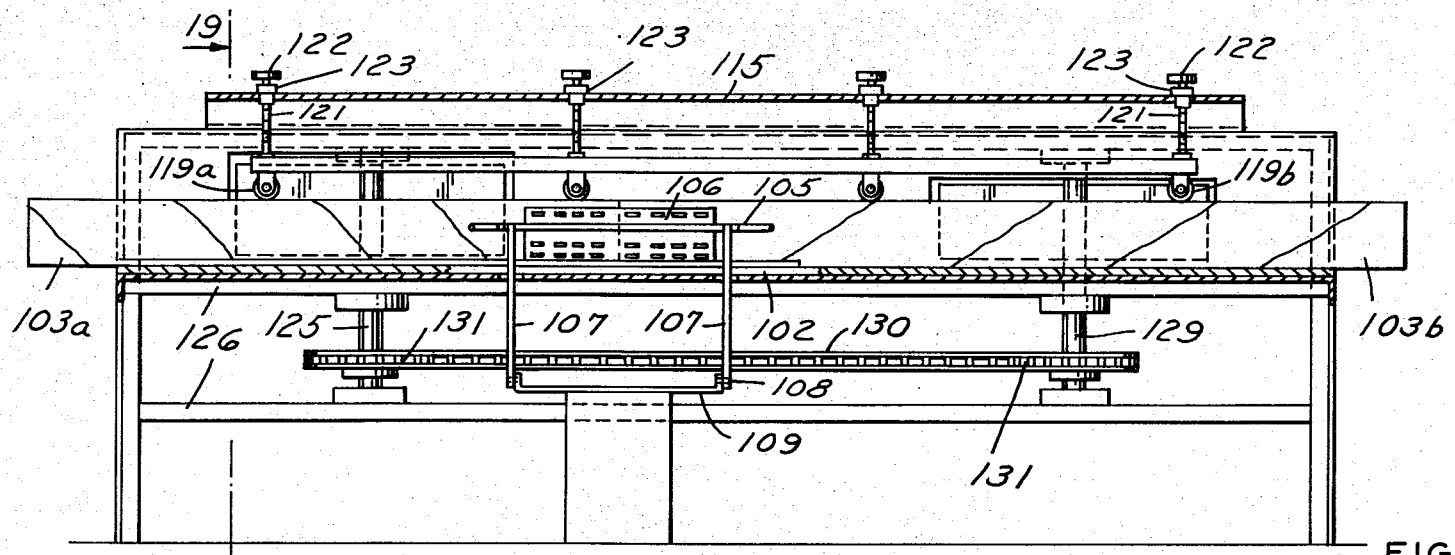
FIG. 18 is a sectional side elevation taken along the line 18—18 of FIG. 17.
Figure 22:
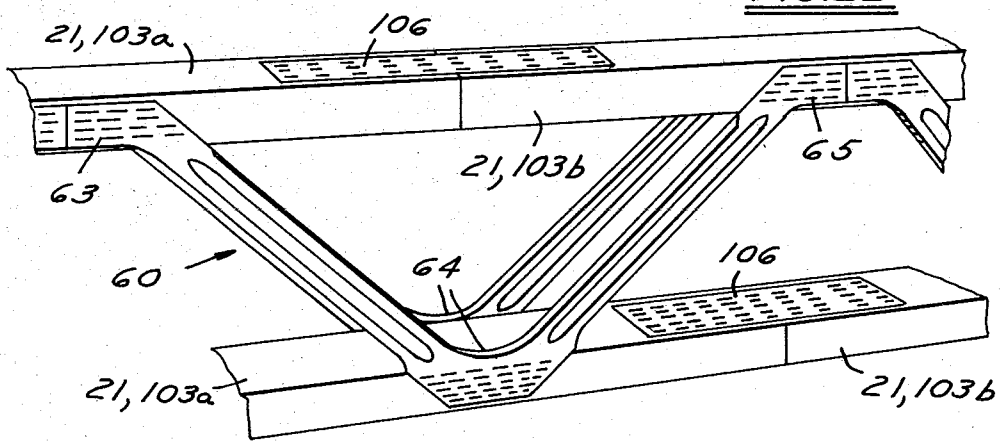
FIG. 22 is a perspective view of a truss assembly employing spliced chords and V-web assembly plates applied in accordance with the apparatus and methods of the present invention.

With reference to FIG. 19, roller segments 124 are illustrated in a compressing position as compared with FIGS. 17, 18 and 21 illustrating the prepositioned condition of the connector plates preparatory to their advance between compressing roller segments. Roller segments 124 are sufficiently wide to accommodate a range of lumber widths, preferably for "2×3, 2×4, and 2×5" lumber, with a second model of the apparatus having heavier drive shafts and wider roller segments to accommodate "2×6 and 2×8" lumber.

While controls for the apparatus have not been illustrated they may be readily understood by those skilled in the art from the following description of a typical cycle: Starting with cover 115 open as illustrated at 118 in FIG. 21 together with guide bars 105 opened by arms 107 to the position illustrated at 107*a* by bellcrank 111, linkage 112 and 113, 2×4s 103*a* and 103*b* with connector plates are prepositioned manually between the open guide bars 105. Simultaneous contact of palm buttons 136 will close a circuit energizing power cylinder 114 to close the cover bringing rollers 119*a* and 119*b* into engagement with respective 2×4s 103*a* and 103*b* to retain them against the surface of track 102 and release bellcrank 111 through linkage 112 and 113 permitting tension spring 110 to move guide bars 105 into light pressure contact with connector plates 106.

Closure of cover 115 through actuation of a limit switch will energize motor 132 to start the drive cycle which will begin to move the 2×4s with their connector plates toward compressing roller segments 124 when such segments with auxiliary roller segments 128 reach the position shown in FIG. 17. Thereafter compressive rolling of the connector plates into splicing engagement will progressively take place as illustrated in FIG. 20 and roller segments 124 and 128 will continue to a release clearance position where a cam actuated limit switch will stop drive motor 132 and energize power cylinder 114 to open cover 115 for unloading.

I claim:

1. Assembly apparatus for securing toothed connector plates to sides of wood members such as 2×4s comprising vertical axis longitudinally fixed side roller means for progressively pressing said connector plates with teeth placed against said wood members ahead of said roller means into wood penetrating assembled relation as they pass said roller means, and means for driving said wood members in required relation together with said connector plates past said side roller means.

2. Assembly apparatus as set forth in claim 1 in which said side roller means includes opposed roller means for simultaneously pressing said connector plates placed against one or both sides of said wood members ahead of said roller means.

3. Assembly apparatus as set forth in claim 2 including adjustment means for accommodating different widths of said wood members.

4. Assembly apparatus as set forth in claim 2 including means for assembling rectangular wood members with their major dimensions in a vertical plane.

5. Assembly apparatus as set forth in any of claims 1-4 including auxiliary roller means ahead of said side roller means and ahead of the location for placing said connector plates against said wood members for driving said wood members into engagement with said side roller means.

6. Assembly apparatus as set forth in claim 2 including vertical axis side roller means for simultaneously engaging both sides of said wood members, and drive means for both of said side roller means.

7. Assembly apparatus as set forth in claim 5 including drive means for said side roller means and synchronized drive means for said auxiliary roller means.

8. Assembly apparatus as set forth in claim 7 including track means for guiding and accurately locating said wood members from said auxiliary roller means relative to said side roller means.

9. Assembly apparatus for securing toothed connector plates to sides of longitudinally end abutting wood members such as 2×4s comprising vertical axis longitudinally fixed side roller means for progressively pressing said connector plates placed against abutting ends of said wood members in overlapping relation ahead of said roller means into wood penetrating assembled relation as they pass said roller means, and means for driving said wood members in required abutting relation together with said connector plates past said side roller means.

10. Assembly apparatus as set forth in claim 9 including opposed roller means for simultaneously pressing said connector plates placed against either side of said wood members ahead of said roller means.

11. Assembly apparatus as set forth in claim 10 including an adjusting means for accommodating different side widths of said wood members.

12. Assembly apparatus as set forth in claim 10 including means for splicing abutting wood members with their width dimension extending in a vertical plane.

13. Assembly apparatus as set forth in any of claims 9-12 including auxiliary roller means ahead of said side roller means and ahead of the location for placing said connector plates against said wood members for driving said wood members with side connector plates positioned to overlap the ends of said wood members into engagement with said side roller means.

14. Assembly apparatus as set forth in claim 10 including vertical axis side roller means for simultaneously engaging both sides of said wood members, and drive means for both of said side roller means.

15. Assembly apparatus as set forth in claim 13 including drive means for said side roller means and synchronized drive means for said auxiliary roller means.

16. Assembly apparatus as set forth in claim 14 including track means for guiding and accurately locating said wood members from said auxiliary roller means relative to said side roller means.

17. Assembly apparatus as set forth in claim 1 for splicing wood members wherein said roller means include limited arc segments adapted to apply compressive rolling and relieved segments adapted to release the wood members for withdrawal from the apparatus and accommodate insertion of additional wood members to be spliced.

18. Assembly apparatus as set forth in claim 17 for splicing wood members wherein a pair of roller segments is provided for compressing the plates in splicing the wood members, and an auxiliary pair of roller segments is adapted to drive the trailing wood member and leading wood member in abutting relation preparatory to and during said compressive rolling.

19. Assembly apparatus as set forth in claim 18 for splicing wood members wherein said auxiliary rollers are synchronized with and timed to precede said compressing segments in engaging said wood members in order to establish and maintain positive abutting relation.

20. Assembly apparatus as set forth in claim 19 for splicing wood members wherein said auxiliary roller segments are constructed to provide a slightly greater peripheral speed than said compressing segments to provide assurance of abutting relation during said splicing operation.

21. Assembly apparatus as set forth in any of claims 17-20 for splicing wood members including retractable side guide means for holding said connector plates in contact with said wood member during transport to said compressing roller segments.

22. A production method for assembling wood members connected by stamped sheet metal elements having toothed extremities fixedly penetrating said wood members comprising the steps of prepositioning said wood members in assembly relation, positioning said elements on respective horizontally spaced sides of said wood members in required relation to each other, driving and guiding said wood members along a horizontal path, and applying synchronized compressive rolling pressure adjusted to the width of said wood members to progressively force said tooth extremities into penetrating assembled relation along the length of said wood members.

23. The method of claim 22 including manual placement of stamped sheet metal elements on either side of the wood members preparatory to compressive rolling.

24. The method of claim 23 with said wood members held in acquired assembly relation adjacent said continuous compressive rolling.

25. The method of claim 24 wherein said continuous compressive rolling is effected with said wood members moving in a substantially horizontal direction.

26. The method of claim 22 adjustably applied to rectangular members having different widths.

27. A production method for splicing the ends of longitudinal wood members connected by stamped sheet metal elements having toothed extremities fixedly penetrating said wood members comprising the steps of prepositioning said wood members in end abutting relation, positioning said elements on respective horizontally spaced sides of said wood members in required overlapping relation to said abutting ends, driving and guiding said wood members along a horizontal path, and applying synchronized compressive rolling pressure adjusted to the width of said wood members to progressively force said toothed extremities into penetrating assembled relation along the length of said wood members.

28. The method of claim 27 including manual placement of stamped sheet metal connector plates on either side and overlapping the abutting wood members preparatory to compressive rolling.

29. The method of claim 27 with said wood members held in abutting relation with their side dimension in a vertical plane adjacent said compressive rolling.

30. The method of claim 29 wherein said compressive rolling is affected with said wood members moving in a substantially horizontal direction.

31. The method of claim 30 adjustably applied to rectangular wood members having different width dimensions.

* * * * *